United States Patent [19]

Hanson

[11] 4,105,383

[45] Aug. 8, 1978

[54] BRICK MOLDING MACHINE

[76] Inventor: David Jack Hanson, River Rd., Newcastle, Me. 04553

[21] Appl. No.: 786,339

[22] Filed: Apr. 8, 1977

[51] Int. Cl.[2] ..... B28B 5/04

[52] U.S. Cl. ..... 425/96; 425/145; 425/219; 425/220; 425/253

[58] Field of Search ..... 425/96, 145, 218–220, 425/253, 261, 432, 456

[56] References Cited

U.S. PATENT DOCUMENTS

| | | | |
|---|---|---|---|
| 1,440,715 | 1/1923 | Bliss | 425/91 |
| 1,550,014 | 8/1925 | Debay | 425/219 |
| 1,559,500 | 10/1925 | Lidseen | 425/219 |
| 2,019,428 | 10/1935 | McCombe | 425/168 |
| 2,061,497 | 11/1936 | Beauchamp | 425/218 |

FOREIGN PATENT DOCUMENTS

| | | | |
|---|---|---|---|
| 658,851 | 6/1929 | France | 425/96 |

*Primary Examiner*—Francis S. Husar
*Assistant Examiner*—John McQuade
*Attorney, Agent, or Firm*—Nicholas J. Aquilino

[57] ABSTRACT

Brick forms on stackable pallets are delivered in succession by a conveyor belt beneath the outlet of a clay hopper equipped with an internal vibrator and a clay feed auger. A pivoted flapper blade trips over each brick form divider wall and assures that the clay is forced first into the forward part of each mold cavity. Water is supplied to the front face of the flapper blade. Immediately beyond the hopper outlet, a diaper assembly having a mechanical vibrator engages each moving form to vibrate the clay and promote random clay crystal orientation. A strike blade on the diaper assembly removes excess clay and water from the top of each moving form. Water is also supplied constantly to the strike blade.

10 Claims, 7 Drawing Figures

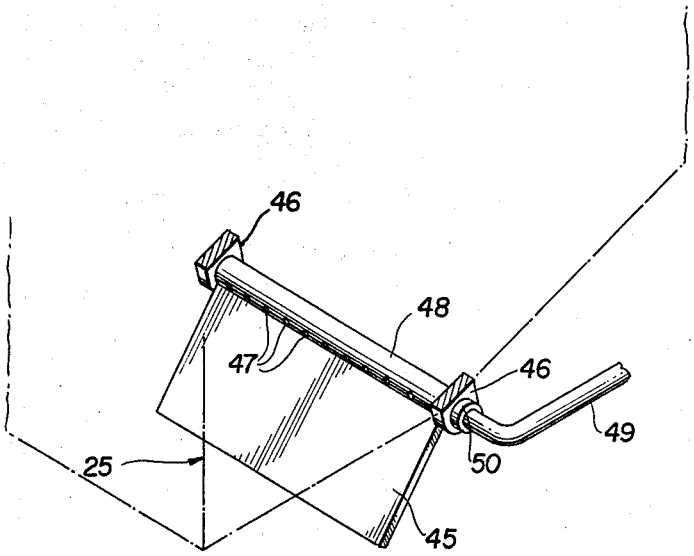
FIG. 4
FIG. 5
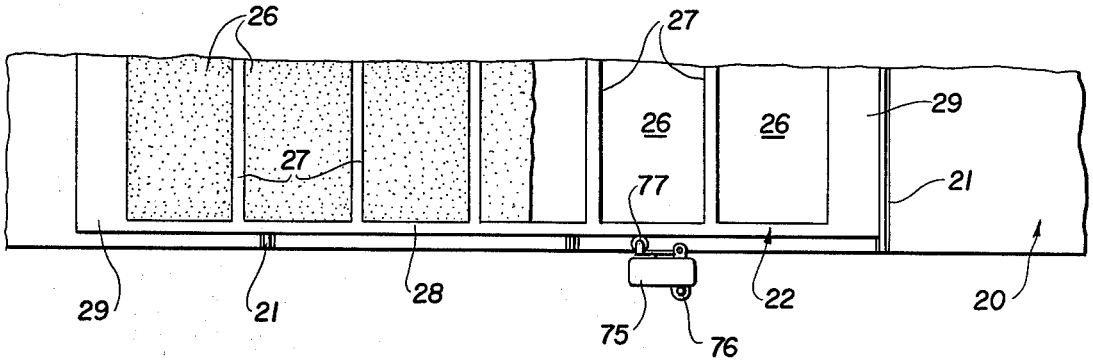
FIG. 6
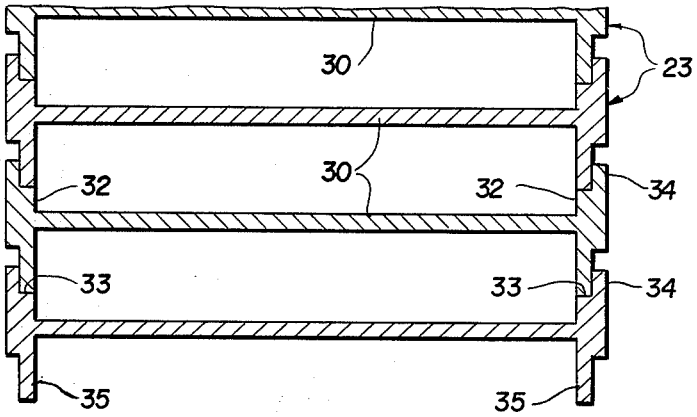

BRICK MOLDING MACHINE

BACKGROUND OF THE INVENTION

The present invention is an apparatus for producing waterstruck or soft mud bricks. Bricks of this type are usually made on reciprocating machines where clay is fed under considerable pressure into a stationary form and subsequently ejected from the machine.

The present invention utilizes a moving conveyor for brick forms into which clay is introduced from an overhead hopper having vibration and feed auger means. Downstream from the hopper, the clay in the moving forms is further vibrated by a diaper assembly as excess clay is struck from the top of the form.

The continuous or moving belt system is simpler and consumes less energy. It is also less expensive to construct and maintain. Additionally, the brick clay is composed of platelike crystals interlocked in a random manner. When the clay is forced under high pressure into a mold cavity, the crystals tend to collapse relative to each other, standing like a deck of cards. This weakens the ultimate structural integrity of the brick under point loading in the plane of stacking. By vibrating the clay as it is delivered into the forms and further vibrating the forms during the striking operation, the random clay crystal pattern remains undisturbed and the resulting bricks are much more resistant to point loading.

Some examples of the known prior art are contained in U.S. Pat. Nos. 1,440,715; 1,782,413; 2,019,428 and 2,061,497.

SUMMARY OF THE INVENTION

Briefly summarized, the invention embodies a level flighted conveyor for brick forms carried by pallets. A clay hopper above this conveyor has an internal vibrator and an inclined clay feed auger delivering clay through a bottom hopper discharge opening at the downstream end of the hopper. The clay enters the brick molding cavities of each moving form and a wet flapper blade on the bottom of the hopper forces the clay toward the front of each mold cavity and then trips over each form transverse divider wall so that the clay can fill each cavity.

Immediately beyond the hopper, a vibration diaper assembly imparts high frequency vibration to each form, and a wet striker blade on the diaper assembly strikes excess clay and water from the top of each form.

BRIEF DESCRIPTION OF THE DRAWINGS

FIG. 4 is a fragmentary perspective view of a flapper blade and associated elements.

FIG. 5 is a fragmentary plan view of conveyor means for forms and an associated feed auger control switch.

FIG. 6 is a vertical cross sectional view of stacked pallets utilized in the apparatus.

DETAILED DESCRIPTION

Figure 1:
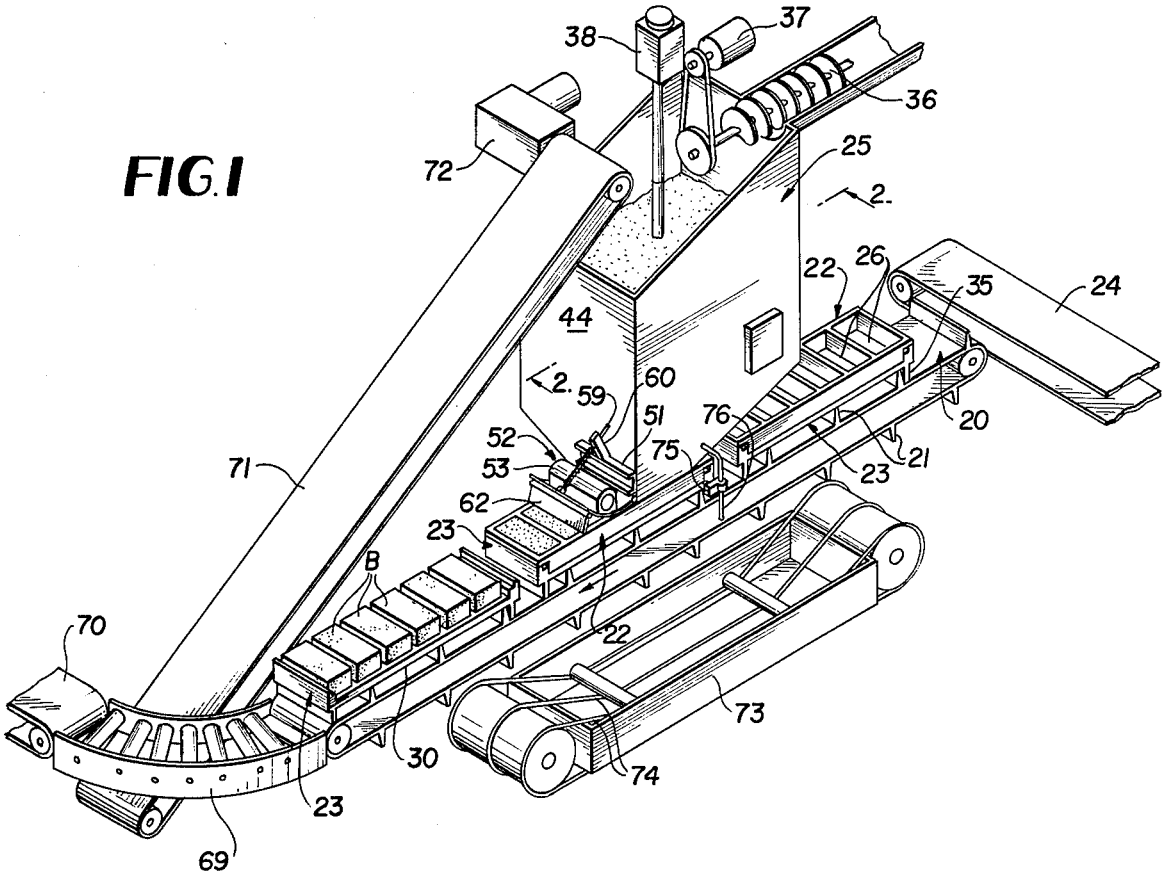
FIG. 1 is a perspective view of brick molding apparatus according to the invention.

Referring to the drawings in detail wherein like numerals designate like parts, a horizontal conveyor belt

20 having spaced flights 21 transports brick forms 22 on pallets 23 from a loading conveyor 24 beneath and downstream from a clay hopper 25.

Figures 2, 7:
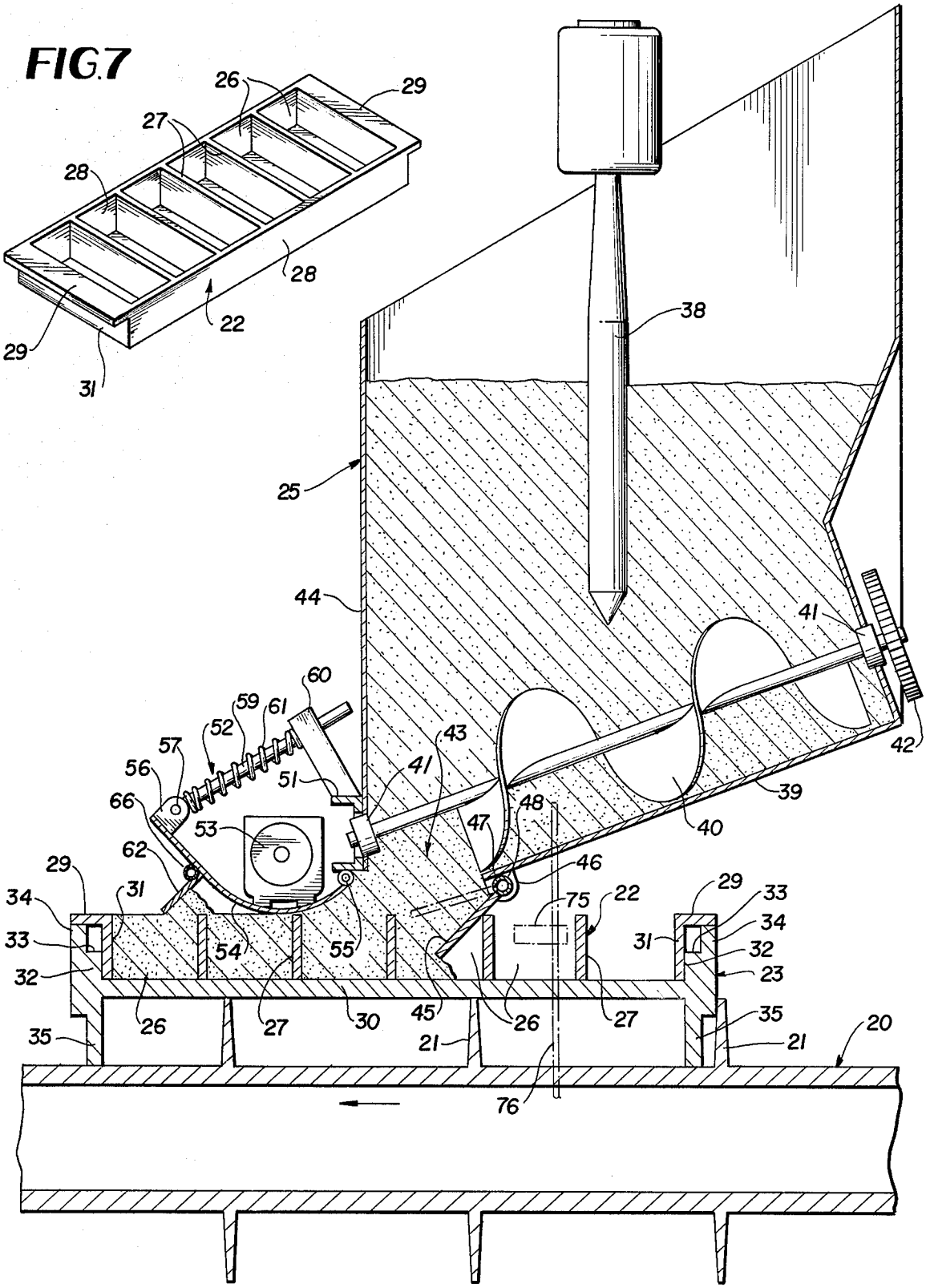
FIG. 2 is an enlarged vertical cross section through the apparatus taken on line 2—2 of FIG. 1.
FIG. 7 is a perspective view of a form utilized with the pallet.

Each form 22 has a series of transverse brick molding cavities 26 open at their tops and bottoms and separated by vertical divider walls 27, the form having side walls 28 at right angles to the divider walls 27 and also having end flanges 29 at the top thereof. Each form 22 is placed on one of the pallets 23 for conveyance with the belt 20, and each pallet has a flat horizontal wall 30 on which the open bottom of the form 22 rests, as clearly shown in FIG. 2. The opposite end walls 31 of each form 22 engage snugly within shoulders 32 at the ends of the pallet 23, and these shoulders form steps 33 on each pallet which facilitate nesting or stacking the pallets 23 in the manner shown in FIG. 6. The form flanges 29 rest on end wall extensions 34 of the pallets and the pallets have end transverse legs 35 or walls which rest on the upper run of belt 20 between the belt flights 21, as illustrated, so that continuous movement of the pallets and forms with the belt is assured during the operation of the apparatus.

The clay hopper 25, which is fixedly positioned in a conventional manner, receives clay with a conventional mixture of sawdust and water through its open top from a clay feed auger 36 having suitable power drive means 37, FIG. 1. The mass of clay in the hopper 25 is subjected to continuous vibration by an internal high frequency vibrator 38 of any known commercial type.

The hopper 25 has an inclined bottom 39 above which is mounted an inclined form feed auger 40 held in bearings 41 on the hopper and driven by power drive means 42. The auger 40 feeds the vibrating clay downwardly and forwardly in relation to the movement of the belt 20 toward a hopper outlet 43 at the lowermost point on the hopper and adjacent to its downstream end wall 44. It can be seen in FIG. 2 that clay is fed directly into the mold cavities 26 of each moving form 22 from the discharge opening 43 as the forms travel with the belt 20 beneath the stationary clay hopper.

An important feature of the invention comprises the provision of a flat pivoted flapper blade 45 on the bottom of the hopper 25 immediately rearwardly of the discharge opening 43, the flapper blade being pivotally suspended from bearings 46 attached rigidly to the hopper. The flapper blade 45 spans the mold cavities 26 transversely and is able to enter each cavity between the side walls 28 of the form. The pivoted flapper blade 45 serves the important purpose of guiding and forcing the clay toward the front of each mold cavity 26 as the clay is delivered from the outlet 43. This assures that the front portion of each cavity is completely filled without any voids. As the form 22 travels forwardly relative to the hopper, the flapper blade 45 will ride over the top of each transverse divider wall 27, FIG. 2, and in so doing, will allow the rear part of each cavity 26 to be filled with clay after the front part of the cavity is first filled.

Water is continuously delivered to the forward face of the flapper blade 45 through apertures 47 formed in a water supply pipe 48 having an extension 49 leading to a source of water. The flapper blade 45 is attached to the apertured pipe 48 fixedly and the pipe thus forms the pivotal support for the flapper blade in the bearings 46. A suitably sealed swivel connection 50 is provided between the pipe 48 and the stationary extension pipe 49. Water from the apertures 47 continually wets the front of flapper blade 45 so that clay will not adhere to the flapper blade.

Immediately downstream from the hopper 25 and fixed to the end wall 44 of the hopper by a sturdy channel member 51 is a vibratory diaper assembly 52 having a high frequency mechanical vibrator unit 53 of a conventional commercial type mounted thereon. The vibrator 53 is fixed to a curved bottom plate 54 or runner of the diaper assembly, the upstream end of this runner being hinged at 55 to the bottom of the channel member 51. The forward end of the plate 54 carries spaced apertured lugs 56 pivotally connected by a pin 57 with the head 58 of a rod 59 which engages guidedly through an aperture in a post 60 rigidly mounted on top of the channel member 51. An expansion spring 61 surrounds the rod 59 between the post 60 and lugs 56 and urges the curved plate 54 downwardly on top of each form 22 passing with the belt 20 beneath the hopper and the diaper unit 52. The vibrator 53 imparts constant high frequency vibration to the plate 54 and through this plate to each form 22 and the clay within the cavities 26 thereof. The plate 54 contacts and rides over the top edges of the form side walls 28, as best shown in FIG. 3.

Figure 3:
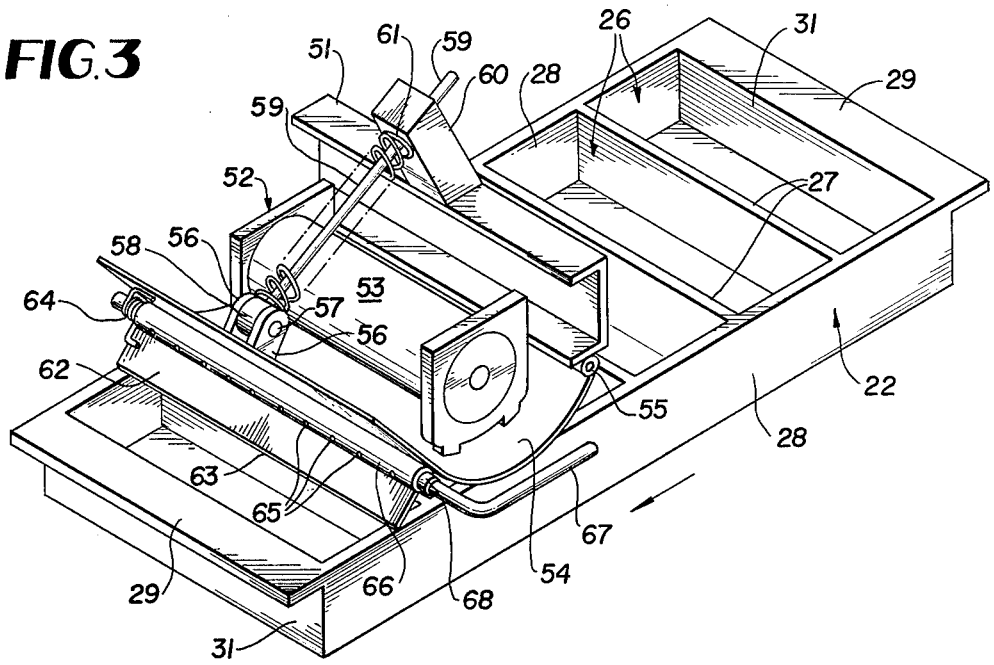
FIG. 3 is a perspective view of a diaper assembly and associated moving brick form.

A strike plate 62 is pivotally attached to the runner or plate 54 near and above the elevation of the moving forms 22 and the depending transverse edge 63 of the strike plate 62 is adapted to ride along the upper edges of the form side walls 28, FIG. 3, as the forms move relative to the diaper assembly 52. The strike plate 63 is yieldingly biased downwardly by a spring means 64, or the like, FIG. 3, and water is continuously delivered to the strike plate through apertures 65 in the transverse mounting pipe 66 to which the strike plate or blade is fixedly attached. Water is supplied to the pipe 66 from an extension pipe 67 connected with a convenient source of water. A sealed swivel joint 68 is provided between the rotating pipe 66 and fixed pipe 67, as described in connection with the pipes 48 and 49 of the flapper blade 45. By maintaining the strike blade 62 wet, it will not stick to the clay and delivers small streams of water on top of the clay in the mold cavities 26 which is desirable. As clearly shown in FIG. 2, the strike blade 62 scrapes of "strikes" excess clay from the top of each form 22 as the forms travel in succession beneath the vibratory diaper assembly 52.

It may now be understood that the clay is subject to constant vibration by the device 38 in the hopper 25 and while it is being delivered through the outlet 43 to the mold cavities 26 of the moving forms. Also constant vibration is being imparted to the moving forms through the runner 54 of the diaper assembly 52 by means of the external vibrator unit 53.

Downstream from the diaper assembly 52 and hopper, the forms 22 are pulled from the pallets 23 leaving the molded bricks B resting on and traveling with the pallets. After leaving the moving conveyor belt 20 and traversing a short section 69, of free roller conveyor, the pallets and bricks enter onto another powered conveyor 70 which delivers the pallets and bricks to a conventional drying or curing area. Excess clay particles are returned to the hopper 25 on an inclined conveyor 71 having power drive means 72.

A form soaking trough 73 containing a water glass solution is provided near one side of the apparatus, and the pulled forms 23 are placed in this trough and are conveyed through it by strands 74 back toward the loading conveyor.

A control microswitch 75 for the form feed auger 40 is secured adjustably to a vertical rod 76 attached to the adjacent side wall of hopper 25, FIG. 1. The actuator 77 of this switch engages the front of each form 22 traveling on the belt 20 to initiate the operation of the auger 40 drive motor, not shown. An associated timer, not shown, maintains the auger 40 in operation for a sufficient time to fill all of the cavities 26 in the form, and then the timer turns off the motor for the auger 40. The timer can be set to provide only the amount of clay required to fill up the form. In some cases, the operation of the auger 40 can be controlled from a machine control console. These control means are all conventional and need not be further described.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A brick molding apparatus comprising a horizontal conveyor, nesting pallets and brick forms traveling on said conveyor, a clay hopper positioned above said conveyor and having a bottom clay outlet at an elevation to deliver clay from the hopper directly into brick mold cavities of said brick forms, vibration means extending into the hopper to vibrate clay therein, clay feed means within the hopper to feed vibrating clay through said bottom clay outlet, a flapper blade pivoted to the bottom of the hopper adjacent said outlet and adapted to enter said mold cavities of the moving brick forms on the conveyor in succession and forcing the clay from said outlet into the forward part of each mold cavity before allowing the clay to fill the rear part of such cavity, said flapper blade adapted to ride over divider walls separating said mold cavities, and a vibrator means near the downstream end of the hopper for contacting each moving form in succession and imparting vibration thereto and including a strike blade element for removing excess clay from the top of each form.

2. A brick molding apparatus as defined in claim 1, and conduit means connected with said flapper blade and strike blade element for delivering water to faces of the flapper blade and strike blade element.

3. A brick molding apparatus as defined in claim 2, and said conduit means for the flapper blade and strike blade element including for each an apertured pipe extending along the top edge of the flapper blade and strike blade element.

4. A brick molding apparatus as defined in claim 1, and said vibrator means near the downstream end of the hopper comprising a curved runner plate hingedly secured to the hopper, a mechanical vibrator unit mounted on said runner plate, and a spring means urging the runner plate downwardly into contact with brick forms traveling thereunder, said strike blade element being secured to said runner plate.

5. A brick molding apparatus as defined in claim 1, and said clay hopper having an inclined bottom to deliver clay toward said outlet, and said means to feed the vibrating clay comprising an auger adjacent said inclined bottom having an axis of rotation parallel thereto.

6. A brick molding apparatus as defined in claim 5, and said auger having a rotational shaft journaled on the end walls of said hopper and having a spiral flight terminating at the upstream end of said clay outlet and in spaced relation to the downstream end wall of the hopper.

7. A brick molding apparatus as defined in claim 1, and said means to vibrate clay in the hopper comprising a mechanical vibration unit inside of the hopper centrally thereof having a vibration element adapted to project into the clay within the hopper.

8. A brick molding apparatus as defined in claim 1, and a control switch for said means to feed the vibrating clay secured to one side of the hopper and having a switch actuator in the path of movement of forms on said conveyor whereby said means to feed can be automatically started and stopped.

9. A brick molding apparatus as defined in claim 1, and said conveyor comprising an endless conveyor belt having spaced flights, pallets carried by said conveyor belt and having fore and aft legs adapted to rest on said belt between flights, and brick forms having plural brick molding cavities resting removably on the pallets, said cavities open at their tops and bottoms, and said pallets having horizontal walls closing the bottoms of said cavities while said forms are resting on said pallets.

10. A brick molding apparatus as defined in claim 9, and said pallets including stepped recess means for positioning said forms on the pallets and also serving to render plural pallets stackable.

* * * * *